US007959407B2

(12) United States Patent
Tholen

(10) Patent No.: US 7,959,407 B2
(45) Date of Patent: Jun. 14, 2011

(54) BLADE OUTER AIR SEALS, CORES, AND MANUFACTURE METHODS

(75) Inventor: Susan M. Tholen, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 12/632,241

(22) Filed: Dec. 7, 2009

(65) Prior Publication Data

US 2010/0080707 A1 Apr. 1, 2010

Related U.S. Application Data

(62) Division of application No. 11/529,120, filed on Sep. 28, 2006, now Pat. No. 7,650,926.

(51) Int. Cl.
*F01D 11/08* (2006.01)

(52) U.S. Cl. ..... 415/115; 415/173.1

(58) Field of Classification Search ..... 415/173.1, 415/173.4, 173.3, 174.1, 174.2
See application file for complete search history.

(56) References Cited

U.S. PATENT DOCUMENTS

| | | | | |
|---|---|---|---|---|
| 4,627,480 | A | 12/1986 | Lee | |
| 5,050,665 | A | 9/1991 | Judd | |
| 5,375,973 | A * | 12/1994 | Sloop et al. | 415/173.1 |
| 5,538,393 | A | 7/1996 | Thompson et al. | |
| 5,993,150 | A | 11/1999 | Liotta et al. | |
| 7,517,189 | B2 * | 4/2009 | Camus | 415/173.1 |
| 2004/0047725 | A1 | 3/2004 | Tomita et al. | |
| 2007/0023157 | A1 | 2/2007 | Otero et al. | |

FOREIGN PATENT DOCUMENTS

| | | | |
|---|---|---|---|
| FR | 2857406 | A1 | 1/2005 |
| JP | 2005042616 | A | 2/2005 |

OTHER PUBLICATIONS

European Search Report for EP Patent Application No. 07252977.9, dated Apr. 6, 2011.

* cited by examiner

*Primary Examiner* — Richard Edgar
(74) *Attorney, Agent, or Firm* — Bachman & LaPointe, P.C.

(57) ABSTRACT

A blade outer air seal (BOAS) casting core has first and second end portions and a plurality of legs. Of these legs, first legs each have: a first end joining the first end portion; a main body portion; and a second end. Second legs each have: a second end joining the second end portion; a main body portion; and a first portion. At least one of the second legs may have its first end joining the core first end portion and a plurality of apertures in the main body portion. Alternatively, at least one of the first legs may have its second end joining the core second end portion and a plurality of apertures in its main body portion.

10 Claims, 6 Drawing Sheets

BLADE OUTER AIR SEALS, CORES, AND MANUFACTURE METHODS

CROSS-REFERENCE TO RELATED APPLICATION

This is a divisional application of Ser. No. 11/529,120, filed Sep. 28, 2006, and entitled BLADE OUTER AIR SEALS, CORES, AND MANUFACTURE METHODS, the disclosure of which is incorporated by reference herein in its entirety as if set forth at length.

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION

The invention relates to gas turbine engines. More particularly, the invention relates to casting of cooled shrouds or blade outer air seals (BOAS).

BOAS segments may be internally cooled by bleed air. For example, there may be an upstream-to-downstream array of circumferentially-extending cooling passageway legs within the BOAS. Cooling air may be fed into the passageway legs from the outboard (OD) side of the BOAS (e.g., via one or more inlet ports at ends of the passageway legs). The cooling air may exit the legs through outlet ports in the circumferential ends (matefaces) of the BOAS so as to be vented into the adjacent inter-segment region. The vented air may, for example, help cool adjacent BOAS segments and purge the gap to prevent gas ingestion.

The BOAS segments may be cast via an investment casting process. In an exemplary casting process, a ceramic casting core is used to form the passageway legs. The core has legs corresponding to the passageway legs. The core legs extend between first and second end portions of the core. The core may be placed in a die. Wax may be molded in the die over the core legs to form a pattern. The pattern may be shelled (e.g., a stuccoing process to form a ceramic shell). The wax may be removed from the shell. Metal may be cast in the shell over the core. The shell and core may be destructively removed. After core removal, the core legs leave the passageway legs in the casting. The as-cast passageway legs are open at both circumferential ends of the raw BOAS casting. At least some of the end openings are closed via plug welding, braze pins, or other means. Air inlets to the passageway legs may be drilled from the OD side of the casting.

U.S. patent application Ser. No. 11/502,046, filed Aug. 10, 2006 discloses use of a refractory metal core configured to reduce the number of end openings which must then be closed.

SUMMARY OF THE INVENTION

One aspect of the invention involves a blade outer air seal (BOAS) casting core. The core has first and second end portions and a plurality of legs. Of these legs, first legs each have: a first end joining the first end portion; a main body portion; and a second end. Second legs each have: a second end joining the second end portion; a main body portion; and a first portion. At least one of the second legs may have its first end joining the core first end portion and a plurality of apertures in the main body portion. Alternatively, at least one of the first legs may have its second end joining the core second end portion and a plurality of apertures in its main body portion.

In various implementations, the core may be formed of refractory metal sheetstock. The core may have a ceramic coating. At least one third leg may connect to the first end portion to the second end portion. The at least one third leg may include first and second perimeter or edge legs.

The core may be embedded in a shell and a casting cast partially over the core. The first and second end portions of the core may project from the casting into the shell. The core may be manufactured by cutting from a refractory metal sheet.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
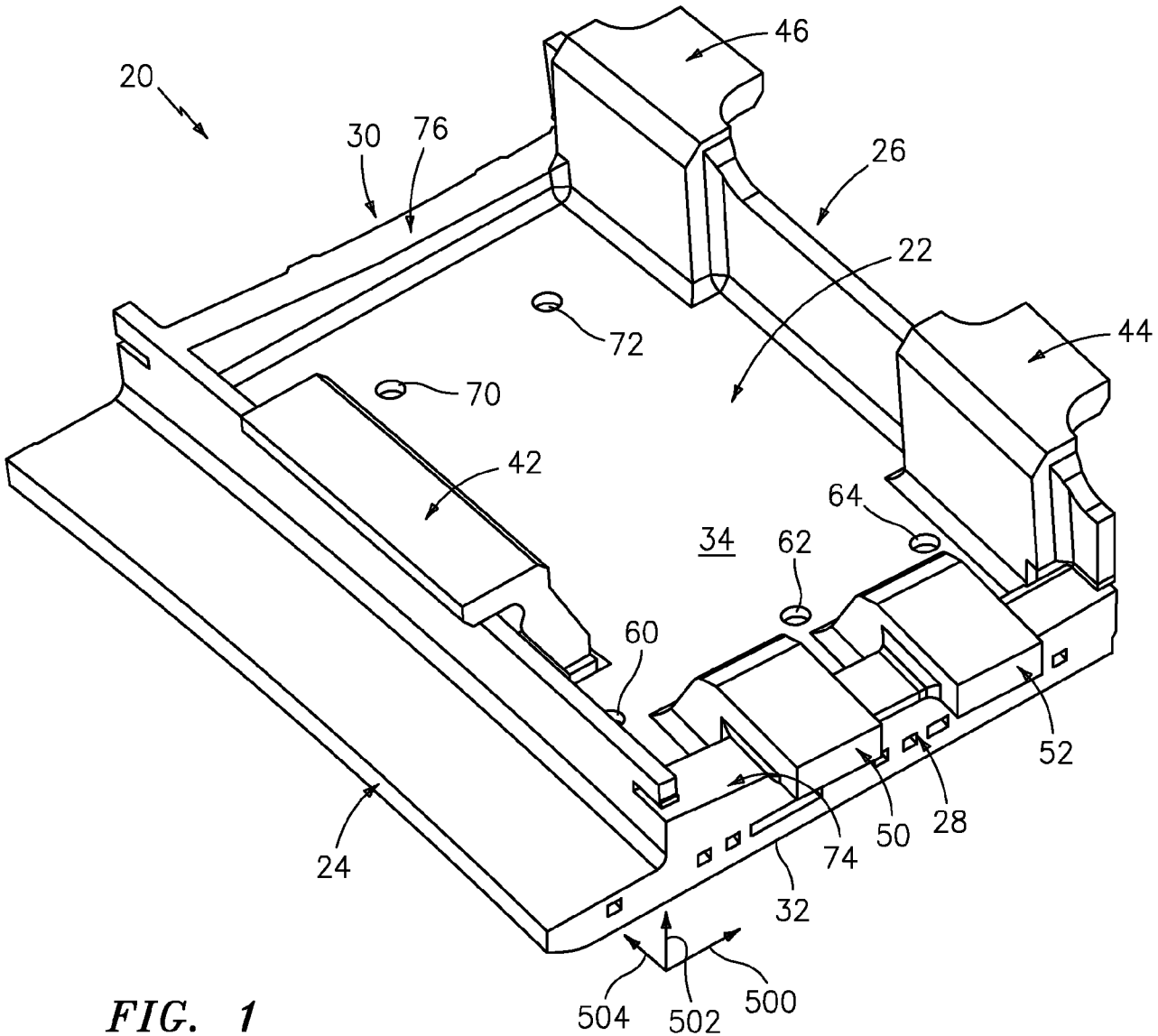
FIG. 1 is a view of a blade outer airseal (BOAS).

FIG. 1 shows blade outer air seal (BOAS) 20. Relative to an installed condition, a downstream/aftward direction 500, radial (outward) direction 502, and circumferential direction 504 are shown. The BOAS has a main body portion 22 having a leading/upstream/forward end 24 and a trailing/downstream/aft end 26. The body has first and second circumferential ends or matefaces 28 and 30. The body has an ID face 32 and an OD face 34. To mount the BOAS to environmental structure 40 (FIG. 3), the exemplary BOAS has a plurality of mounting hooks. The exemplary BOAS has a single central forward mounting hook 42 having a forwardly-projecting distal portion recessed aft of the forward end 24. The exemplary BOAS has a pair of first and second aft hooks 44 and 46 having rearwardly-projecting distal portions protruding aft beyond the aft end 26.

Figure 3:
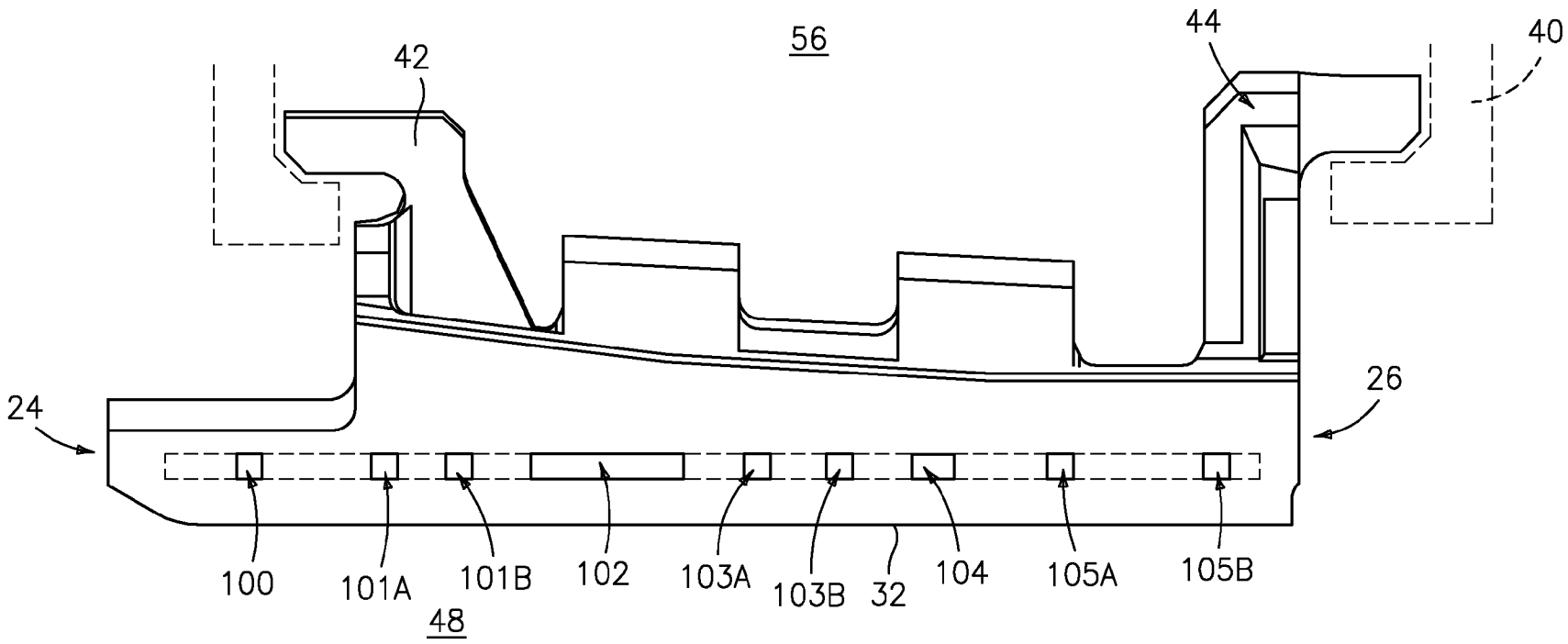
FIG. 3 is a first circumferential end view of the BOAS of FIG. 1.
Figure 4:
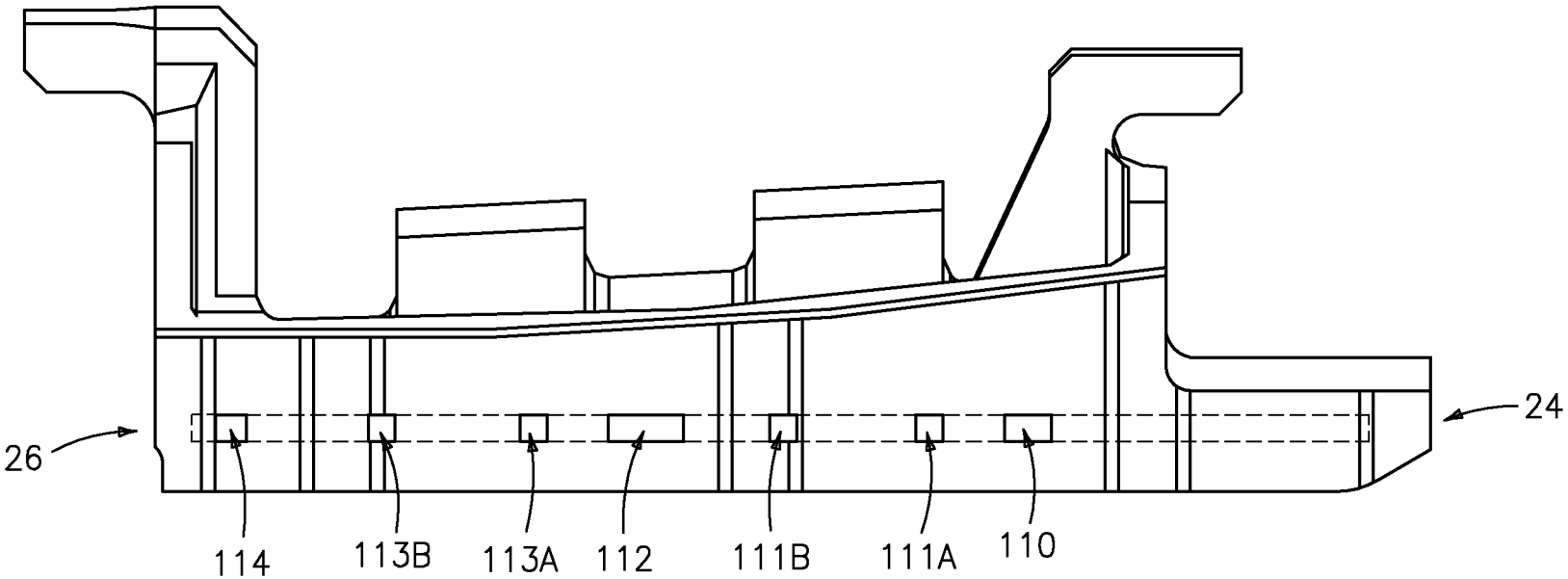
FIG. 4 is a second circumferential end view of the BOAS of FIG. 1.

A circumferential ring array of a plurality of the BOAS 22 may encircle an associated blade stage of a gas turbine engine. The assembled ID faces 32 thus locally bound an outboard extreme of the core flowpath 48 (FIG. 3). The BOAS 22 may have features for interlocking the array. Exemplary features include finger and shiplap joints. The exemplary BOAS 22 has a pair of fore and aft fingers 50 and 52 projecting from the first circumferential end 28 and which, when assembled, radially outboard of the second circumferential end 30 of the adjacent BOAS.

Figure 2:
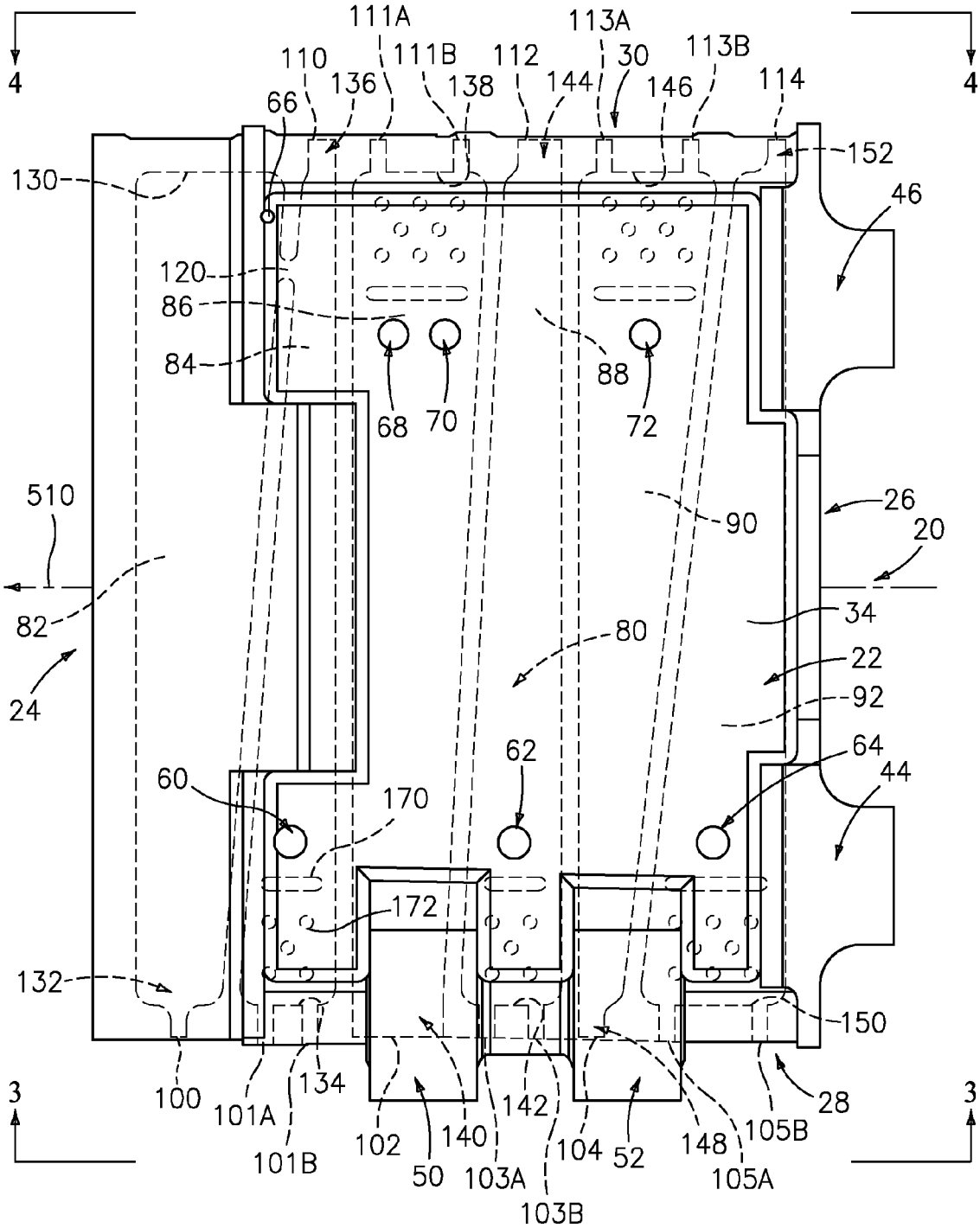
FIG. 2 is an OD/top view of the BOAS of FIG. 1.

The BOAS may be air-cooled. For example, bleed air may be directed to a chamber 56 (FIG. 3) immediately outboard of the face 34. The bleed air may be directed through inlet ports 60, 62, 64, 66, 68, 70, and 72 (FIG. 2) to an internal cooling passageway system 80. The inlet ports may be spaced apart from adjacent side rails 74 and 76 (FIG. 1). The exemplary system 80 includes a plurality of circumferentially-extending legs 82, 84, 86, 88, 90, and 92.

The system 80 may have a plurality of outlet ports. Exemplary outlet ports may include outlets along the circumferential ends 28 and 30. In the exemplary BOAS 22, outlets 100, 101A and 101B, 102, 103A and 103B, 104, and 105A and 105B are formed along the first circumferential end 28 and outlets 110, 111A and 111B, 112, 113A and 113B, and 114 are formed along the second circumferential end 30. As is discussed in further detail below, one or more pairs of adjacent legs may be interconnected by interconnecting passageways 120. Additional outlets may be distributed along the ID face 32.

In operation, the inlet 66 feeds the leg 82 near a closed end 130 of the leg 82. The air flows down the leg 82 to outlet 100 which is in a neck region at the other end 132 of the leg 82. The inlet 60 feeds the leg 84 near an end 134 from which neck regions extend to the outlets 101A and 101B. The outlet 110 is at a neck region at the other end 136. A main body portion of the leg 84 extends between the neck regions at either end. A longitudinal radial centerplane 510 of the BOAS 22 cuts across the legs between the circumferential ends 28 and 30. The exemplary inlet 60 is nearer to the adjacent circumferential end 28 than to the plane 510. The exemplary leg 82 generally tapers (narrows in width and cross-sectional area) along a main body portion extending from the neck regions at the end 134 to the neck region at the end 136.

The BOAS may reflect a reengineering of a baseline BOAS. Relative to a baseline BOAS, the port 60 may be shifted toward the plane 510 and away from the side rail 76. The shift away from the side rail may reduce the risk of low cycle fatigue (LCF) cracking. The reengineering may add the outlets 101A and 101B. The reengineering may also add a series of obstacles/obstructions in the leg 84 between the shifted location of the port 60 and the adjacent end 134. As is discussed below, the obstacles may serve to restrict the amount of flow which would otherwise exit the outlets 101A and 101B and, thereby, provide a desired circumferential flow bias. As is discussed further below, the exemplary obstacles include a metering wall 170 and a series of posts 172. By metering of the flow, the obstacles permit the presence of the port(s) 101A and 101B in the adjacent circumferential end rather than necessitating their elimination (either via plug welding or casting reconfiguration). Contrasted, on the one hand, with a closed end, the presence of the ports 101A and 101B avoids or reduces local flow stagnations and improves local cooling near the circumferential end 28. Contrasted, on the other hand, with larger port(s) and the absence of the flow restrictions associated with the obstacles, air loss and the associated dilution of the engine core flow is reduced. Port size may be limited by the use of refractory metal core (RMC) casting technology as is discussed below.

In a similar fashion to the inlet 60, the inlets 68 and 70 feed the leg 86 near an end 138 from which neck regions extend to the outlets 111A and 111B. The outlet 102 is formed at the other end 140. The inlet 62 feeds the leg 88 near an end 142 from which neck regions extend to the outlets 103A and 103B. The outlet 112 is at the other end 144. The inlet 72 feeds the leg 90 near an end 146 from which neck regions extend to the outlets 113A and 113B. The outlet 104 is in a neck region at the other end 148. The inlet 64 feeds the leg 92 near an end 150 from which neck regions extend to the outlets 105A and 105B. The outlet 114 is formed in a neck region at the other end 152.

Figure 5:
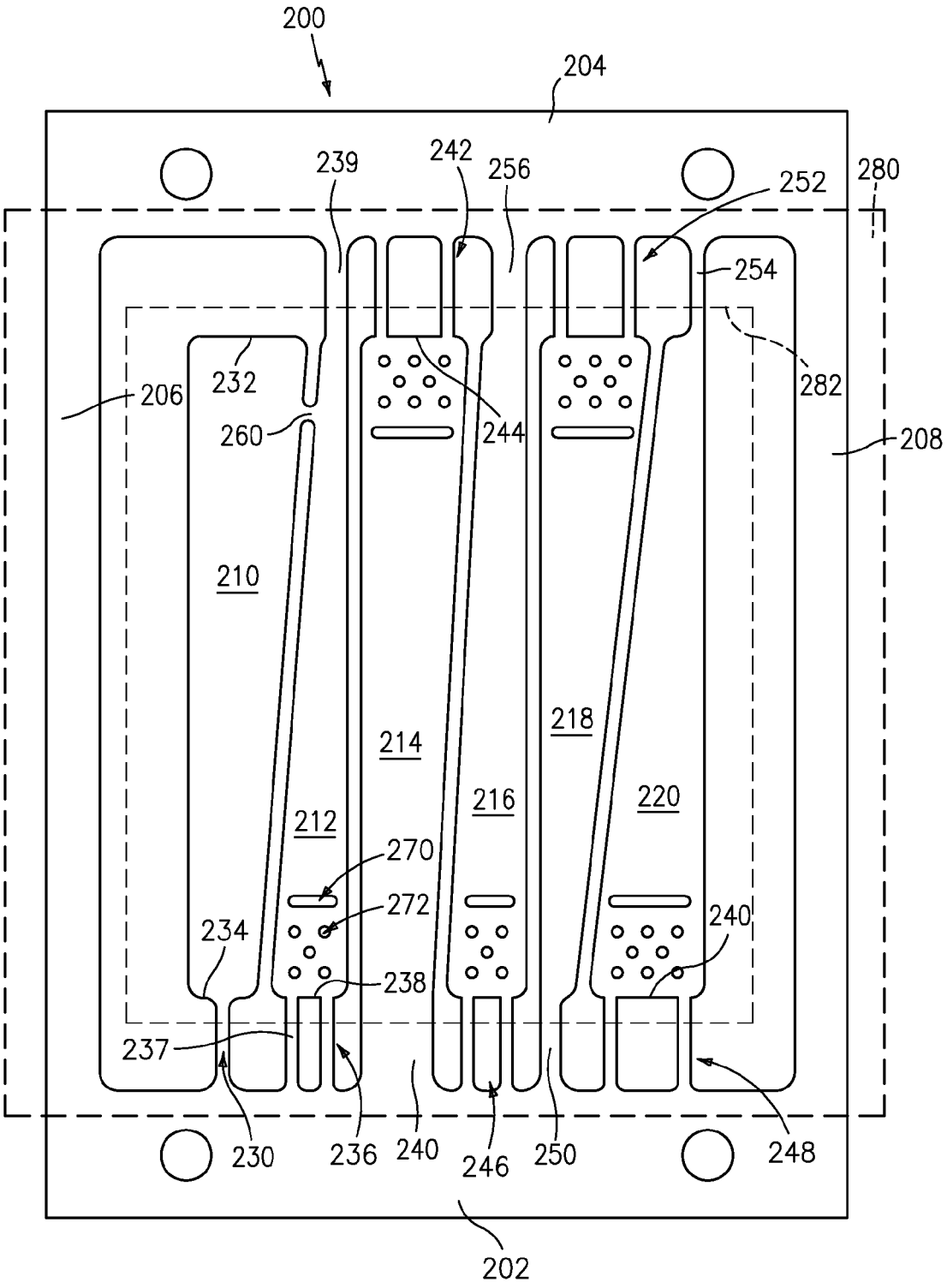
FIG. 5 is a plan view of a refractory metal core (RMC) for casting a cooling passageway network of the BOAS of FIG. 1.

FIG. 5 shows a refractory metal core (RMC) 200 for casting the passageway legs. The core 200 may be cut from a metallic sheet (e.g., of a refractory metal). An exemplary cutting is laser cutting. Alternative cutting may be via a stamping operation. The exemplary RMC 200 has first and second end portions 202 and 204. First and second perimeter legs 206 and 208 extend between and join the end portions 202 and 204 to form a frame-like structure. Between the perimeter legs 206 and 208, there is an array of legs 210, 212, 214, 216, 218, and 220 which respectively cast the passageway legs 82, 84, 86, 88, 90, and 92. The exemplary leg 210 has a first end portion 230 joining with the core first end portion 202. A second end portion 232 is free, spaced-apart from the core second end portion 204. A main body portion of the leg 210 extends between a shoulder 234 of the end portion 230. The exemplary end portion 230 is formed as a neck for casting the outlet 100. To provide stability lost by the absence of an end portion connecting to the core end portion 204, a connecting portion 260 connects the main body portion of the leg 210 to the main body portion of the leg 212. The portion 260 ends up casting the passageway 120.

The leg 212 has a first end portion 236 formed as a pair of necked portions 237 extending from a shoulder 238 and joining with the core first end portion 202. A second end portion 239 is formed as a necked portion joining the core second end portion 204. Although a single necked portion 237 may be used, core stability favors using two spaced-apart portions 237. These can provide equivalent stability to a single portion of larger overall cross-section (and thus associated airflow and air losses through the associated ports 101A and 101B).

The leg 214 has a first end portion 240 joining with the core first end portion 202. A second end portion 242 comprises a pair of necked portions extending from a shoulder 244 of the main body portion and joining with the core second end 204 in similar fashion to the joining of the end portion 236 with the core first end portion 202. First end portions 246 and 248 of the legs 216 and 220 may be similarly formed as the end portion 236. The first end portion 250 of the leg 218 may be similarly formed to the portion 230. The second end portion 252 of the leg 218 may be similarly formed to the end portion 242. A second end portion 254 of the leg 220 may be similarly formed to the end portion 239. A second end portion 256 of the leg 216 may be similarly formed to the end portion 239.

Each of the exemplary legs 212, 214, 216, 218, and 220 is formed with apertures for casting the obstructions in the associated passageway leg. Exemplary apertures include an elongate metering aperture 270 for casting the wall 170 and a plurality of less eccentric (e.g., circular-sectioned) apertures 272 between the aperture 270 and the adjacent end of the main body portion for casting the posts 172.

Figure 6:
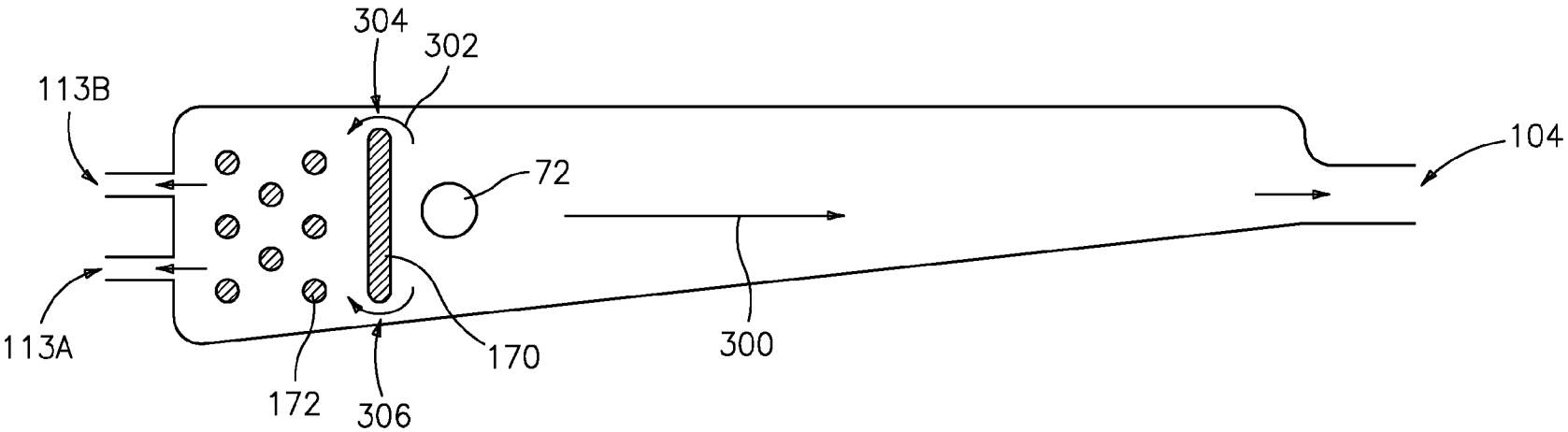
FIG. 6 is a view of a passageway leg of the BOAS of FIG. 1.

FIG. 6 is an outward schematic view of the passageway leg 90. Airflow entering through the inlet 72 is divided into first and second flows. The first flow 300 passes toward and through the outlet 104. The second flow 302 must pass around the wall 170. The exemplary wall 170 leaves first and second gaps 304 and 306 at either end around which portions of the second flow 302 pass. The size of the gaps is selected to achieve a desired flow amount. The second flow then passes through the array of posts 172 to exit the outlets 113A and 113B. The posts 172 provide increased local heat transfer.

The reengineering may involve providing increased cooling to the BOAS. In an exemplary reengineering situation, the shift of the inlet provides the two resulting flows with shorter flowpath length than the length (circumferential) of the baseline passageway legs. In some situations the baseline legs may have been flow-limited due to the pressure loss from the friction along the relatively larger flowpath length. The ratio of pressures just before to just after the outlet determines the flow rate (and thus the cooling capability). For example, a broader reengineering of the engine may increase BOAS heat load and thus increase cooling requirements. Thus, reducing the pressure drop by shortening the flowpath length may provide such increased cooling. This provides an alternative to circumferentially shortening the BOAS (which shortening leads to more segments per engine and thus more cost and leakage) or further complicating the passageway configuration. Alternatively, the reengineering may increase the BOAS circumferential length and decrease part count/cost and air loss.

From an airflow perspective, the connecting portion(s) 120 may advantageously be positioned at locations along the adjacent legs wherein air pressure in the cast passageway legs will be equal. This may minimize cross-flow and reduce losses. However, such location may provide less-than-desirable RMC strengthening. Thus, as a compromise, the connecting portion may be shifted (e.g., pushed circumferentially outward) relative to the optimal pressure balancing location.

FIG. 5 also schematically shows a shell 280 having an internal surface 282. The shell 280 is formed over a wax pattern containing the RMC 200 for casting the BOAS. After dewaxing, casting, and deshelling/decoring, the inlets 60, 62, 64, 66, 68, 70, and 72 may be drilled (e.g., as part of a machining process applied to the raw casting).

Although illustrated with respect to an RMC, alternative core materials may be used, including molded ceramics. There may be one or more of several advantages to using an RMC. Use of an RMC relative to a ceramic core may permit the casting of finer passageways. For example, core thickness and passageway height may be reduced relative to those of a baseline ceramic core and its cast passageways. Exemplary RMC thicknesses are less than 1.25 mm, more narrowly, 0.5-1.0 mm. The RMC may also readily be provided with features (e.g., stamped/embossed or laser etched recesses) for casting internal trip strips or other surface enhancements.

Although implemented as a particular modification of a particular existing BOAS and passageway configuration, other modifications and other baselines may be used. The modification/reengineering may involve greater change to overall passageway planform/layout. More or fewer of the passageways may be modified than are those of the exemplary BOAS.

Further variations may involve radially constricting the interconnecting passageway(s) 120, if any, to have a smaller thickness (radial height) than characteristic thickness (e.g., mean, median, or modal) of the adjacent passageway legs. This may be provided by a corresponding thinning of the RMC connecting portion 260. Exemplary thinning may be from one or both RMC faces and may be performed as part of the main cutting of the RMC or later. Such a thinning may also replace one or more of the core apertures for forming the associated restriction(s).

One or more embodiments of the present invention have been described. Nevertheless, it will be understood that various modifications may be made without departing from the spirit and scope of the invention. For example, when implemented in the reengineering of a baseline BOAS, or using existing manufacturing techniques and equipment, details of the baseline BOAS or existing techniques or equipment may influence details of any particular implementation. Accordingly, other embodiments are within the scope of the following claims.

What is claimed is:

1. A shroud comprising:
a main body portion having:
a forward end;
an aft end;
first and second circumferential ends;
an ID face;
an OD face;
a plurality of mounting hooks; and
a plurality of passageway legs including:
a plurality of first legs, each having:
a first end open to the first circumferential end;
an inlet port from the OD face; and
a second end proximate the second circumferential end; and
a plurality of second legs, each having:
a first end proximate the first circumferential end;
an inlet port from the OD face; and
a second end open to the second circumferential end, wherein:
for at least one of the first legs:
the second end is open to the second circumferential end;
the inlet port is nearer to the second circumferential end than to the first circumferential end; and
a plurality of posts radially span the leg between the inlet port and the second end; or
for at least one of the second legs:
the first end is open to the first circumferential end;
the inlet port is nearer to the first circumferential end than to the second circumferential end; and
a plurality of posts radially span the leg between the inlet port and the first end.

2. The shroud of claim 1 wherein the plurality of mounting hooks includes:
a single central forward mounting hook having a forwardly projecting distal portion recessed aft of the forward end; and
a pair of first and second aft hooks having rearwardly projecting distal portions protruding aft beyond the aft end.

3. The shroud of claim 1 wherein:
the first legs and second legs alternate longitudinally.

4. The shroud of claim 1 wherein:
a longitudinal width of each of the first and second legs tapers continuously along majorities of circumferential spans of such leg and the shroud.

5. The shroud of claim 1 further comprising:
at least one connector branch connecting an adjacent pair of said first and second legs and having minimum cross-section smaller than adjacent cross-sections of the connected legs.

6. A shroud comprising:
a main body portion having:
a forward end;
an aft end;
first and second circumferential ends;
an ID face;
an OD face;
a plurality of mounting hooks; and
a plurality of passageway legs each including:
a first end open to the first circumferential end;
an inlet port from the OD face;
a second end open to the second circumferential end; and
at least one local cross-sectional area reduction in an open portion of the leg with leg portions on both sides of the reduction having larger cross-sectional areas.

7. The shroud of claim 6 wherein for at least a first of the legs:
the inlet port is closer to the second circumferential end than to the first circumferential end; and
the reduction is between the inlet port and the second circumferential end.

8. The shroud of claim 7 wherein for at least a second of the legs:

the inlet port is closer to the first circumferential end than to the second circumferential end; and the reduction is between the inlet port and the first circumferential end.

9. The shroud of claim 6 wherein:

the reduction comprises an elongate wall radially spanning the leg and leaving fore and aft gaps.

10. A method for engineering the shroud of claim 6 from a baseline configuration, the method comprising:

shifting the inlet port toward a circumferential center of the shroud;

adding the reduction; and opening the second end.

* * * * *